US008399806B2

(12) United States Patent
Son et al.

(10) Patent No.: US 8,399,806 B2
(45) Date of Patent: Mar. 19, 2013

(54) BUILT-IN TYPE COOKER

(75) Inventors: Chang-Hyun Son, Changwon (KR); Byung Yong Yoo, Changwon (KR); Ki-Hwan Kim, Changwon (KR); Yun-Geon Baek, Changwon (KR); Sang-Dong Park, Changwon (KR)

(73) Assignee: LG Electronics Inc., Seoul (KR)

( * ) Notice: Subject to any disclaimer, the term of this patent is extended or adjusted under 35 U.S.C. 154(b) by 532 days.

(21) Appl. No.: 12/631,573

(22) Filed: Dec. 4, 2009

(65) Prior Publication Data

US 2010/0200557 A1 Aug. 12, 2010

(30) Foreign Application Priority Data

| | | |
|---|---|---|
| Dec. 5, 2008 | (KR) | 10-2008-0123167 |
| Jan. 16, 2009 | (KR) | 10-2009-0003694 |
| Jan. 16, 2009 | (KR) | 10-2009-0003695 |
| Jan. 16, 2009 | (KR) | 10-2009-0003696 |
| Mar. 9, 2009 | (KR) | 10-2009-0019794 |

(51) Int. Cl.
*H05B 1/00* (2006.01)

(52) U.S. Cl. ..... 219/209; 219/201

(58) Field of Classification Search ..... 219/201, 219/209

See application file for complete search history.

(56) References Cited

U.S. PATENT DOCUMENTS

| | | | |
|---|---|---|---|
| 4,665,893 | A | 5/1987 | Miyagawa et al. |
| 7,348,521 | B2 | 3/2008 | Lee et al. |

FOREIGN PATENT DOCUMENTS

| | | | |
|---|---|---|---|
| CN | 200955787 | Y | 10/2007 |
| JP | 2-295091 | A | 12/1990 |
| JP | 2007-280744 | A | 10/2007 |
| KR | 10-2001-0019507 | A | 3/2001 |
| KR | 10-0595280 | B1 | 6/2006 |
| KR | 10-2007-0037175 | A | 4/2007 |
| KR | 10-0747810 | B1 | 8/2007 |
| KR | 10-0829627 | B1 | 5/2008 |

*Primary Examiner* — Long Pham

(74) *Attorney, Agent, or Firm* — Birch, Stewart, Kolasch & Birch, LLP

(57) ABSTRACT

Provided is a built-in type cooker including a heat dissipation part connected to an electronic component and exposed to the outside of the cabinet. The built-in type cooker include a cabinet having an upwardly opened polyhedral shape, a top plate covering a top surface of the cabinet, the electronic component installed within the cabinet, and the heat dissipation part in which at least portion thereof is exposed to the side of the cabinet, the heat dissipation part being connected to the electronic component.

20 Claims, 9 Drawing Sheets

BUILT-IN TYPE COOKER

CROSS-REFERENCE TO RELATED APPLICATIONS

This non-provisional application claims priority under 35 U.S.C. §119(a) to Korean Patent Application Nos. 10-2008-0123167, 10-2009-0003696, 10-2009-0003694, 10-2009-0003695 and 10-2009-0019794 filed in the Republic of Korea on Dec. 5, 2008, Jan. 16, 2009, Jan. 16, 2009, Jan. 16, 2009 and Mar. 9, 2009, respectively, the entire contents of which are hereby incorporated by reference into the present application.

BACKGROUND

Embodiments relate to a built-in type cooker.

Generally, cookers are home appliances that heat foods using heat and/or microwave energy. Specifically, a cooker installed within furniture is referred to as a built-in type cooker. Such a built-in type cooker includes a cabinet, a plurality heating sources disposed within the cabinet, and a top plate covering a top surface of the cabinet. The cabinet is received into the furniture, and a top surface of the top plate is exposed to the outside.

Foods are heated by the heating sources to cook the food in a state where a cooking container in which the foods are received is seated on the top surface of the plate. At this time, heat generated from the heating sources is transferred to the foods as well as the entire cooker.

SUMMARY

Embodiments provide a cooker in which harmful components contained in a meat are discharged to the outside during a cooking process and a method for controlling the same.

Embodiments also provide a cooker in which a meat is well cooked and a method for controlling the same.

The details of one or more embodiments are set forth in the accompanying drawings and the description below. Other features will be apparent from the description and drawings, and from the claims.

DETAILED DESCRIPTION OF THE EMBODIMENTS

Reference will now be made in detail to the embodiments of the present disclosure, examples of which are illustrated in the accompanying drawings.

In the following detailed description of the preferred embodiments, reference is made to the accompanying drawings that form a part hereof, and in which is shown by way of illustration specific preferred embodiments in which the invention may be practiced. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense, and the scope of the present invention is defined only by the appended claims.

Figure 1:
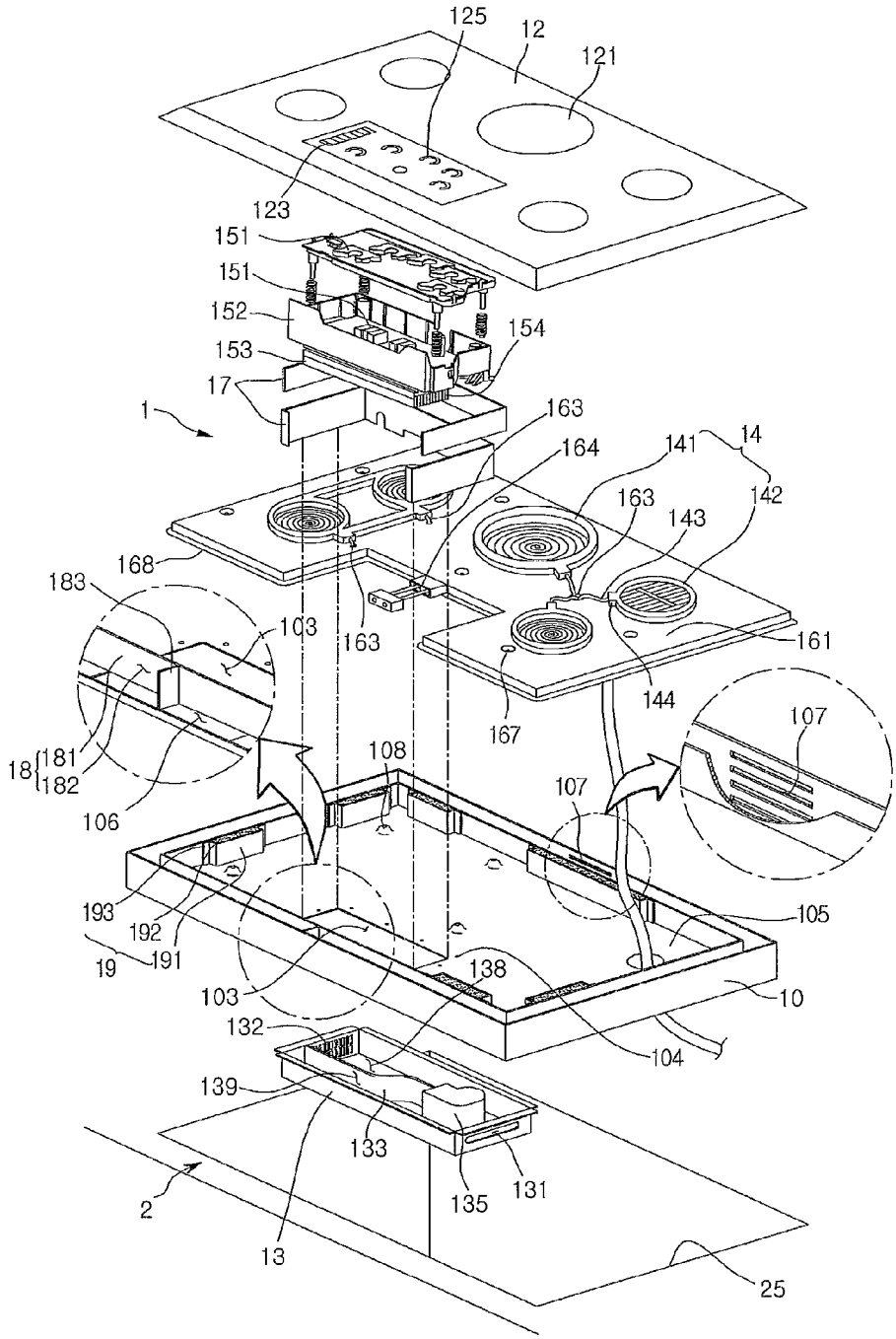
FIG. 1 is an exploded perspective view of a built-in type cooker according to a first embodiment.
Figure 2:
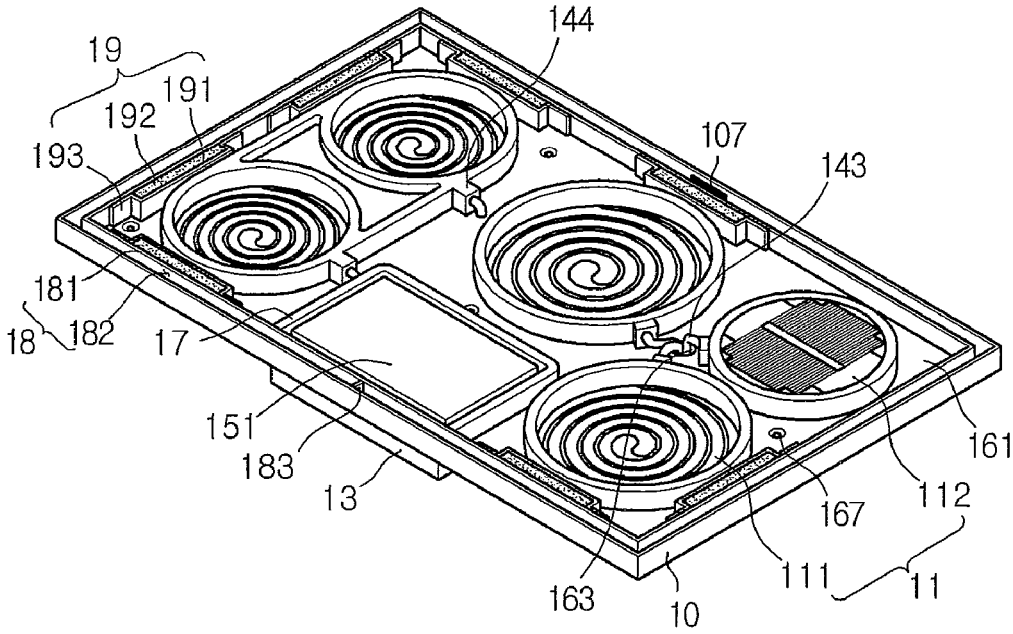
FIG. 2 is a partially perspective view of the built-in type cooker according to the first embodiment.
Figure 3:
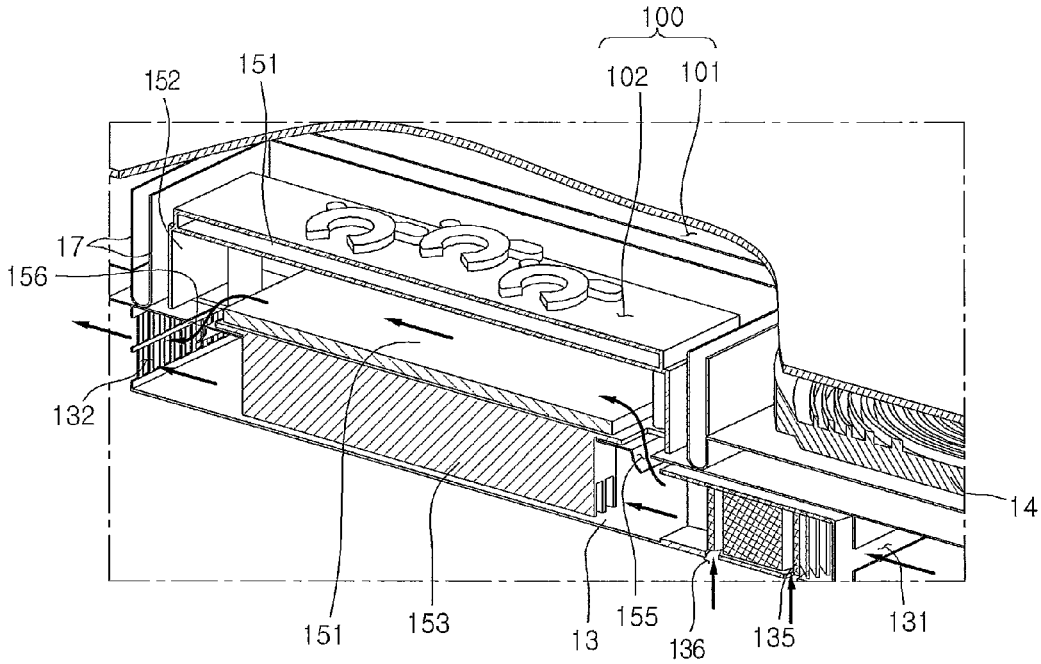
FIG. 3 is a sectional perspective view of the built-in type cooker according to the first embodiment.
Figure 4:
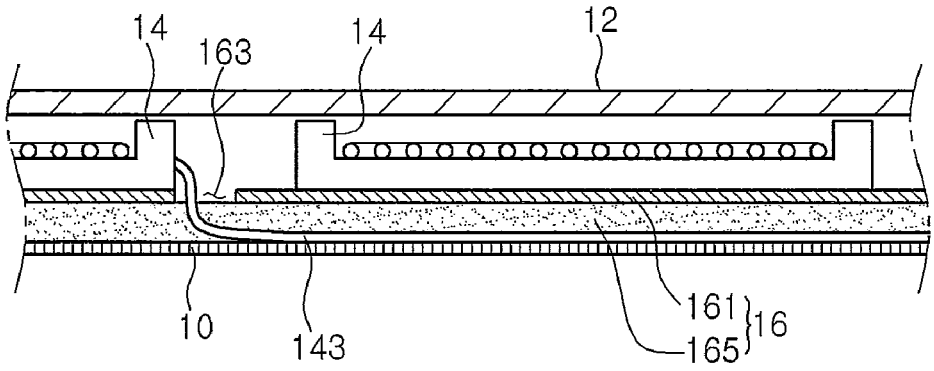
FIG. 4 is a sectional view of the built-in type cooker according to the first embodiment.
Figure 5:
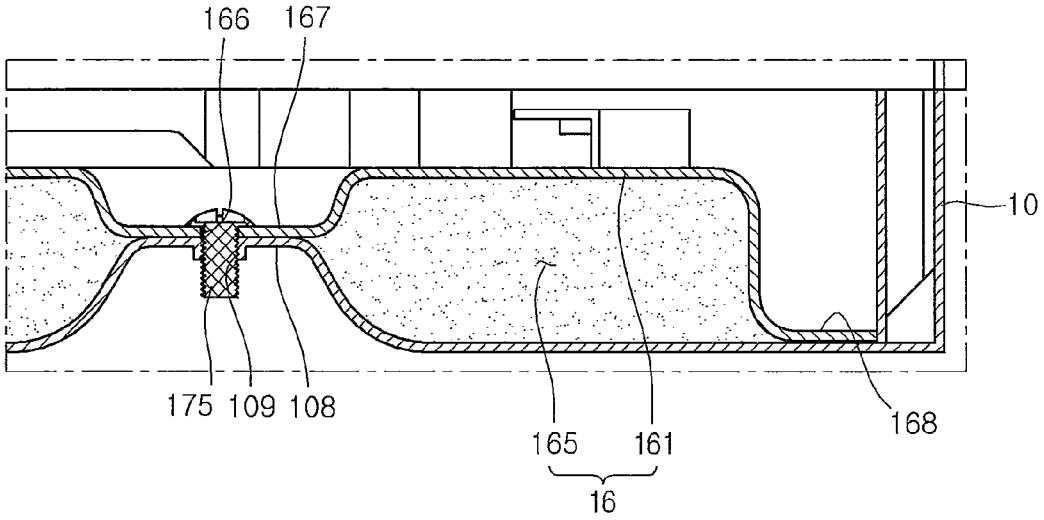
FIG. 5 is a partially sectional view of the built-in type cooker according to the first embodiment.
Figure 6:
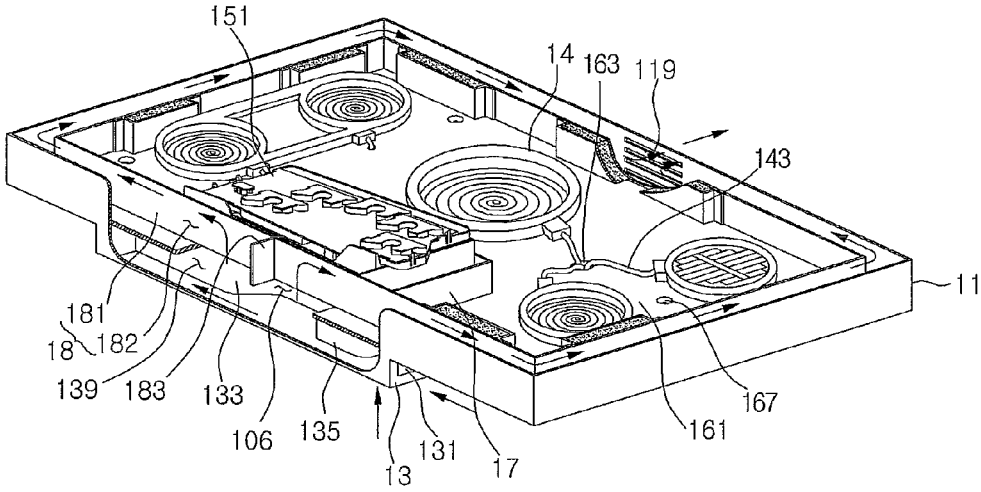
FIG. 6 is a partially sectional perspective view of the built-in type cooker according to the first embodiment.

FIG. 1 is an exploded perspective view of a built-in type cooker according to a first embodiment, and FIG. 2 is a partially perspective view of the built-in type cooker according to the first embodiment. FIG. 3 is a sectional perspective view of the built-in type cooker according to the first embodiment, and FIG. 4 is a sectional view of the built-in type cooker according to the first embodiment. FIG. 5 is a partially sectional view of the built-in type cooker according to the first embodiment, and FIG. 6 is a partially sectional perspective view of the built-in type cooker according to the first embodiment.

Referring to FIGS. 1 to 6, a cooker 1 is installed within furniture. In detail, an upwardly opened opening 25 is defined in the furniture, and the cooker 1 is received in the opening 25.

The cooker 1 includes a cabinet 10 receiving various devices for cooking foods, a heating source 14 for heating the foods, a top plate 12 for seating the foods, an electronic component 151 for operating the cooker 1, and a base cover 13 disposed on an under surface of the cabinet 10.

In detail, the cabinet 10 has an approximately rectangular parallelepiped shape opened upwardly. An installation space for receiving the heating source 14 and the electronic component 151 is defined in the cabinet 10. The installation space 100 is divided by a partition 17 into a heating part installation space 101 in which the heating source 14 is disposed and an electronic component installation space 102 in which the electronic component 151 is disposed.

An opening 102 for installing and cooling the electronic component 151 is defined in a bottom surface of the cabinet 10 corresponding to the electronic component installation space 102. Also, a coupling hole 104 for coupling the base cover is defined in the bottom surface of the cabinet 10. Furthermore, a hole 105 for installing a power supply line for operating the cooker 1 is defined in the bottom surface of the cabinet 10.

A communication opening 106 through which air suctioned through the base cover 13 flows into a flow passage 182 that will be described later is defined in a side of a front end of the bottom surface of the cabinet 10 corresponding to a portion at which the flow passage 182 vertically overlaps the base cover 13. Also, a discharge hole 107 through which the air flowing through the flow passage 182 is discharged to the outside is defined in a rear surface of the cabinet 10. At this time, an outwardly downwardly inclined discharge opening cover (not shown) may be disposed on the discharge hole 107 to prevent the foods streaming down toward the discharge hole 107 from being introduced into the discharge hole 107.

The heating source 14 is disposed inside the cabinet adjacent to the top plate 12. The heating source 14 may include various heaters such as a heater that heats the foods through conduction and radiation or an induction heater. The heating source 14 includes a heating source 141 for cooking, which concentrates a relatively large amount of heat into the foods to cook the foods and a heating source 142 for keeping warm, which keeps the cooked foods in a warm state. Although the heating source 14 is fixed to a top surface of a support 161 in this embodiment, the heating source 14 may be fixed to an under surface of the top plate 12. Also, although the heating source is provided in plurality in this embodiment, one heating source 14 may be provided.

An electric wire connection part 144 to which an electric wire 143 for supplying a power to the heating source 14 and adjusting an output of the heating source 14 are connected is disposed at a side of the heating source 14. At this time, although the heating source 14 is fixed to the top surface of the support 161 in this embodiment, the heating source 14 may be fixed to the under surface of the top plate 12. Also, although the heating source 14 is provided in plurality in this embodiment, one heating source 14 may be provided.

A lateral insulation plate 19 for minimizing heat transfer from the heating source 141 for cooking to the cabinet is disposed inside the cabinet 10. The lateral insulation plate 19 is disposed between the heating source 141 for cooking and the cabinet 10. The lateral insulation plate 19 may have a thickness in a vertical direction and an area in a horizontal direction with respect to an inner circumference surface of the cabinet 10.

In detail, the lateral insulation plate 19 includes an insulation bracket 191 disposed between the heating source 141 for cooking and the cabinet 10 and an insulation material 192 received into the insulation bracket 191. Here, the insulation bracket 191 is longitudinally disposed along the inner circumference surface of the cabinet 10. The insulation bracket 191 includes a fixing part 193, in which both ends thereof are bent toward the circumference surface of the cabinet 10 in a '□' shape, and then bent in a direction parallel to the circumference surface of the cabinet 10 in the '□' shape. The fixing part 193 is fixed to the inner circumference surface of the cabinet 10. Here, the fixing part 193 may be fixed through various methods such as a method in which the fixing part 193 is fixed using a coupling unit such as a screw or bolt and a net, a method in which the fixing part 193 adheres using an adhesive having high heat resistability, and a method in which the fixing part 193 is welded by welding. Also, the insulation bracket 191 may be fixed to various objects such as the under surface of the cabinet 10 or the bottom surface of the top plate 12. The insulation material 192 is received into a space defined between the insulation bracket 191 and the inner circumference surface of the cabinet 10.

Here, the lateral insulation plate 19 is disposed on the inner circumference surface of the cabinet 10 corresponding to a distance less than a preset distance from the lateral insulation plate 19 up to the heating source 141 for cooking in a direction perpendicular to the inner circumference surface of the cabinet 10. Alternatively, the lateral insulation plate 19 may be disposed to correspond one to one with a region corresponding to a distance less than a preset distance from the lateral insulation plate 19 up to the heating source 141 for cooking in a direction perpendicular to the inner circumference surface of the cabinet 10 on the inner circumference surface of the cabinet 10. That is, the lateral insulation plate 19 is intermittently disposed along the inner circumference surface of the cabinet 10.

The lateral insulation plate 19 is spaced a predetermined distance from the heating source 141 for cooking. However, the lateral insulation plate 19 may be fixed to the heating source 141 for cooking and spaced a predetermined distance from the inner circumference surface of the cabinet 10.

Here, heat transfer between from the heating source 141 for cooking to the cabinet 10 may be minimized by the lateral insulation plate 19 disposed between the heating source 141 for cooking and the cabinet 10. Thus, it may prevent the cabinet 10 from being heated, and also, heat may be minimally transferred into a space between the cabinet 10 and the furniture 2 through the cabinet 10.

Therefore, it may prevent the furniture 2 from being damaged or deformed by the heat generated from the heating source 14.

The electric wire 143 configured to supply the power to the heating source 14 and/or adjust the output of the heating source 14 is connected to a side of the heating source 14. The electric wire 143 electrically connects the heating source 14 to the electronic component 151 or connects at least one of the heating source 14 and the electronic component 151 to a power source.

The top plate 12 is disposed at an upper side of the cabinet 10. An input part 123 for inputting various signals related to an operation of the cooker 1 and a display part 125 for displaying an operation state of the heating source 14 are disposed on the top surface of the top plate 12. The input part 123 may include a button, a dial, or a touch panel. The display part 125 may include a liquid crystal display device or a plurality of light emitting units. Cooking container seat parts 121 on which a container receiving the foods is seated are disposed on the top surface of the top plate 12. The cooking container seat parts 121 are disposed corresponding to the heating source 14.

The top plate 12 has an area greater than that of the cabinet 10. Thus, in a state where the built-in type cooker 1 is received into the opening 25, only a lower surface of a circumference of the top plate 12 is seated on a top surface of the furniture 2, and the cabinet 10 is completely received into the opening 25.

The electronic component 151 may include a control part for controlling an operation of the cooker 1, a power supply part for supplying the power to the heating source 14, an output adjustment part for adjusting the output of the heating source 14, and an internal circuit corresponding to the input part 123 and the display part 125.

The electronic component 151 is fixed to the cabinet 10 by the fixing part 152. The fixing part 152 has a bottom surface having a shape corresponding to that of the electronic component 151 and a lateral surface extending upwardly from a circumference of the bottom surface by a predetermined height. The electronic component 151 is seated and fixed inside the fixing part 152. The fixing part 152 is seated and fixed to the bottom surface of the cabinet 10 corresponding to the electronic component installation space 102. Alternatively, the electronic component 151 may be directly fixed to the cabinet 10.

A downwardly extending heat dissipation part 153 is disposed on the bottom surface of the fixing part 152. The heat dissipation part 153 is connected to the electronic component 151 to transfer heat generated in the electronic component 151 to the heat dissipation part 153. At this time, a hole may be defined in the bottom surface of the fixing part 152 to directly contact the electronic component 151 with the heat dissipation part 153, or the fixing part 152 may be formed of a material having a high heat conductivity to connect the electronic component 151 to the heat dissipation part 153 through the fixing part 152.

An outer surface of the heat dissipation part 153 except a portion of the heat dissipation part 153 contacting the electronic component 151 contacts air. At this time, a plurality of fins 154 for increasing a contact area between the heat dissipation part 153 and the air is disposed on the heat dissipation part 153 to effectively cool the heat dissipation part 153 through the air. The plurality of fins 154 is arranged laterally parallel to each other such that the air smoothly flows in a lateral direction.

A suction opening 155 through which air outside the cabinet is suctioned toward the electronic component 151 and a discharge opening 156 for discharging the suctioned air to the outside of the cabinet 10 via the electronic component 151 are defined in a side of the fixing part 153. Here, the inside of the fixing part 152 communicates with the inside of the case cover 13 through the suction opening 155 and the discharge opening 156.

The support 161 for preventing the heat generated in the heating source 14 from being diffused and supporting the heating source 161 is seated on the bottom surface of the cabinet 10 corresponding to the heating part installation space 101. The circumference of the support 161 is bent downwardly and extends, and thus is seated on the bottom surface of the cabinet 10. Alternatively, a seat part 168 in which the circumference of the support 161 is formed downwardly and seated on the bottom surface of the cabinet 10 is disposed on the support 161. That is, in a state where the support 10 is seated on the cabinet 10, only the seat part 168 contacts the bottom surface of the cabinet 10. Thus, a space is defined between the support 161 corresponding to the inside of the seat part 168 and the bottom surface of the cabinet 10. Then, the insulation material 165 is received into the space.

The support 161 has an area less than that of a virtual square defined by a partitioning member 181 that will be described later such that the support 161 is seated on the bottom surface of the cabinet 10 corresponding to the inside of the partitioning member 181. Also, the support 161 corresponds to the bottom surface of the cabinet 10 except a portion corresponding to the inside of the insulation plate 19. The heating source 14 is fixed to a top surface of the support 161. Here, a fixing part (not shown) for fixing the heating source 14 to the top surface of the support may be disposed.

Alternatively, a bottom insulation plate 16 for preventing heat generated in the heating source 14 from being diffused is disposed on the bottom surface of the cabinet 10. The bottom insulation plate 16 includes the support 161 defining the insulation space between the heating source 14 and the bottom surface of the cabinet 10 and the insulation material 165 received into the space defined by the support 161.

A hole 162 through which the electric wire 143 connected to the heating source 14 passes is defined in the support 161. In detail, the hole 162 includes an inlet hole 163 through which the electric wire 143 is introduced into the bottom insulation plate 16 and an outlet hole 164 through which the electric wire 143 is withdrawn from the bottom insulation plate 16. At this time, the inlet hole 163 is defined at a position adjacent to the heating source 14 connected to the electric wire 143 passing through the inlet hole 163.

Also, the inlet hole 163 may be defined at a position corresponding to the same distance with respect to at least two heating sources 14 adjacent to each other of the plurality of heating sources 14. Of course, when two heating sources 14 are provided, the inlet hole 163 may be defined at a position corresponding to the shortest distance of the same distance with respect to two heating sources 14. In this case, the electric wires 143 connected to the heating source 14 corresponding to the same distance with respect to the inlet hole 163 may pass through the inlet hole 163.

The outlet hole 164 through which the electric wire 143 passing through the support 161 and disposed between the support 161 and the bottom surface of the cabinet 10 is connected to the electronic component 151 is defined at a side of the support 161. The side of the support 161 in which the outlet hole is defined may extend toward the electronic component 151 by a predetermined distance to protect a portion of the electric wire 143 connected to the electronic component 151 from the heat generated in the heating source 14.

When described from the viewpoint of the electric wire 143, the electric wire 143 connected to the heating source 14 passes through the inlet hole 163 and is disposed in the insulation space corresponding between the support 161 and the bottom surface of the cabinet 10. That is, the bottom insulation plate 16 is disposed on the electric wire 143 between the remaining portion except a portion connected to the heating source 14 and the heating source 14. An opposite end of an end connected to the heating source 14 is connected to the electronic component 151 through the outlet hole 164 on the electric wire 143. Also, the opposite end may be connected to the power source through the holes 105 and 162 defined in the support 161 or the cabinet 10.

Thus, the damage of the electric wire 143 due to the heat generated in the heating source 14 may be minimized. This is done because the bottom insulation plate 16 is disposed between the remaining portion except the portion connected to the heating source 14 and the heating source 14. Thus, the heat of the heating source 14 may be minimally transferred to the electronic component 151 by the electric wire 143.

Since the electric wire 143 is received into the bottom insulation plate 16, the electric wire 143 is isolated from the internal components of the cooker 1 such as the heating source 14. In detail, the bottom insulation plate 16 is disposed on the electric wire 143 between the remaining portion except the portion connected to the heating source 14 and the internal components. Thus, it may prevent at least one of the internal components from being damaged by interference between the electric wire 143 and the internal components.

Also, since the electric wire 143 is fixed by the inlet hole 163 and the outlet hole 164 of the support 161 and covered by the support 161, the inside of the cabinet may be further cleaned.

Furthermore, since the inlet hole 163 is defined at the position corresponding to the same distance from at least two heating sources adjacent to each other of the plurality of heating sources 14, the similar effect may be obtained using the fewer inlet holes 163 than the number of the heating sources 14.

Forming parts 167 and 108 are defined in the bottom surfaces of the support 161 and the cabinet 10, respectively. The forming part 167 of the support 161 and the forming part 108 of the cabinet 10 are disposed at positions corresponding to each other. The forming part 167 of the support 161 is formed downwardly, and the forming part 108 of the cabinet 10 is formed upwardly. As a result, the forming part 167 of the support 161 and the forming part 108 of the cabinet 10 contact each other. That is, the sum of depths of the forming part 167 of the support 161 and the forming part 108 of the cabinet 10 is equal to a thickness of an air layer formed between the support 161 and the bottom surface of the cabinet 10. One or more forming parts 167 and 108 may be provided.

Coupling holes 166 and 109 through which a coupling member 175 for coupling the support 161 to the cabinet 10 passes are defined in a portion at which the forming part 167 of the support 161 contacts the forming part 108 of the cabinet 10. When the coupling member 175 is a bolt, screw threads are disposed on inner surfaces of the coupling holes 166 and 109 to couplet the bolt to the coupling holes 166 and 109. However, the coupling member is not limited to the bolt, and various coupling units are used as the coupling member.

A phenomenon in which an inner portion of the support 161 is deformed and sank downwardly may be minimized by the forming parts 167 and 108. In detail, an external force is applied downwardly to the support 161 due to a weight of the heating source 14. Also, the support 161 may be deformed downwardly due to a self-weight thereof. Since the self-weight of the support 161 increases toward an inner portion thereof, the deformation due to the self-weight may increase toward the inner portion of the support 161.

The support 161 is supported to the bottom surface of the cabinet 10 through the forming part 167 of the support 161 and the forming part 108 of the cabinet 10. Specifically, since the forming parts 161 and 108 support the support 161 corresponding to an inner portion of the seat part 168, the phenomenon in which the inner portion of the support 161 is deformed and sank downwardly may be minimized.

Also, since the support 161 and the cabinet 10 are coupled through the seat part of the support 161 as well as the forming part 167 of the support 161 and the forming part 108 of the cabinet 10, the support 161 and the cabinet 10 may be firmly coupled to each other.

Furthermore, in a state where the coupling member 175 passes through the coupling holes 166 and 109 defined in the forming parts 167 and 108 of the support 161 and the cabinet 10 and is coupled to the coupling holes 166 and 109, the coupling member 175 is disposed inside the forming parts 167 and 108. That is, in a state where the support 161 is coupled to the cabinet 10, both ends of the coupling member 175 do not protrude upwardly from the support 161 or downwardly from the bottom surface of the cabinet 10. Thus, an outer appearance of the cooker 1 may be protected, and also, utilizability of the inner space of the cooker 1 may be improved.

A flow path 182 for preventing the heat generated in the heating source 14 from being transferred to the furniture 2 is disposed inside the cabinet 10. The flow path 182 is disposed between the cabinet 10 and the partitioning member 181. At this time, the partitioning member 181 is disposed at a position spaced a predetermined distance from the inside of the cabinet 10. Also, the partitioning member 181 partitions the inside of the cabinet 10 into the inside of the flow path 181 and the remaining space except the flow path 181. That is, the flow path 182 is disposed along a circumference surface of the cabinet 10.

A flow path partitioning part 183 for dividing air flowing from the communication opening 106 toward the inside of the flow path 182 to guide the air in directions opposite to each other is disposed at a side of the flow path 182 corresponding to the communication opening 106. An upper end, a front end, and a rear end of the flow path partitioning part 183 are closely attached to the top plate 12, the cabinet 10, and the partitioning member 181, respectively. Also, a lower end of the flow path partitioning part 183 is disposed in a direction in which the communication opening 106 is divided into two spaces in section.

The base cover 13 has an approximately rectangular parallelepiped shape opened upwardly. The base cover 13 is disposed on the under surface of the cabinet 10 corresponding to the electronic component installation space 102. Alternatively, the base cover 13 may be disposed on the under surface of the cabinet 10 corresponding to the hole 103 and the communication opening 106.

An airflow hole through which air flows into the inside and outside thereof is defined in the base cover 13. The airflow hole of the base cover 13 includes a lateral suction hole 131 and a bottom suction hole 136 for suctioning air and a lateral discharge hole 132 for discharging the air passing through the heat dissipation part 153 to the outside. At this time, the lateral discharge hole 132 is defined in a lateral surface of the base cover 13 corresponding to a rear side with respect to a guide part 133 (that will be described later) of the base cover 13. Also, the bottom suction hole 136 is defined in a bottom surface of the base cover 13 corresponding to a lower side of a cooling fan 135 that will be described later.

Components for cooling the electronic components 151 are received inside the base cover 13. The components for cooling the electronic components 151 may include the heat dissipation part 153 for radiating heat of the electronic component 151 and the cooling fan 135 for blowing air toward the heat dissipation part 153. Alternatively, the cooling fan 135 discharges the air from the lateral suction hole toward the lateral discharge hole.

The heat dissipation part 153 is exposed to the inside of the base cover 13, i.e., the outside of the cabinet 10 through the opening. At this time, at least portion of the electronic component 151 may be received into the base cover 13.

The cooling fan 135 is disposed at a side adjacent to the suction holes 131 and 136 of the base cover 13 with respect to the heat dissipation part 153 to prevent the cooling fan 135 from being damaged by the heat radiated from the heat dissipation part 153. Alternatively, the heat dissipation part 153 is disposed at a side of a direction in which the air is discharged from the cooling fan 135 with respect to the cooling fan 135.

The guide part 133 for guiding the suctioned air is disposed to guide a portion of the air suctioned through the suction holes 131 and 136 toward the heat dissipation part 153 and the remaining air toward the flow path 182 of the cabinet 10. In detail, the guide part 133 divides the inside of the base cover 13 into a first flow path 138 through which a portion of the suctioned air flows toward the heat dissipation part 153 to cool the heat dissipation part 153 and a second flow path 139 through which the remaining air flows toward the flow path 182 of the cabinet 10. The heat dissipation part 153 is disposed in the first flow path 138, and the second flow path 139 communicates with the communication opening 106 and the flow path 182 of the cabinet 10.

According to the cooker 1, since the heat dissipation part 153 is disposed outside the cabinet 10, the inner space of the cabinet 10 is further wide when compared that the heat dissipation part 153 is disposed inside the cabinet 10. Thus, the wide inner space of the cabinet 10 may be used for other purposes such as an installation of the heating source 14 having a further high output performance and larger size.

Also, since the electronic component 151 is disposed inside the cabinet 10, the cooker 1 may have a relatively low height when compared that the electronic component 151 is disposed outside the cabinet 10. Thus, a space required for installing the cooker 1 may be further reduced.

Furthermore, the cooling fan 135 is disposed at the side adjacent to the suction holes 131 and 136 of the base cover 13 with respect to the heat dissipation part 153. Thus, it may prevent the cooling fan 135 from being damaged by the high-temperature air heated by the heat dissipation part 153.

Hereinafter, an airflow for cooling the electronic component in the built-in type cooker according to this embodiment will be described in detail.

Referring to FIG. 3, an operation of the cooker 1 starts, and heat is generated from the electronic component 151. Specifically, a large amount of heat is generated from the output adjustment part for adjusting the output of the heating source 14. The heat dissipation part 153 directly contacting the electronic component 151 is heated by the heat generated from the electronic component 151.

Also, as the operation of the cooker 1 starts, the cooling fan 135 is operated also. As a result, air is suctioned to the inside of the base cover 13 through the suction holes 131 and 136 of the base cover 13 due to a pressure difference generated by the cooling fan 135. The suctioned air flows toward the heat dissipation part 153. A portion of the suctioned air flows toward the electronic component 151 through the suction opening 155 defined in the fixing part 152.

At this time, the heat dissipation part 153 is cooled by the air passing through the heat dissipation part 153. Thus, the electronic component 151 is indirectly cooled by the air passing through the heat dissipation part 153. Also, the electronic component 151 is directly cooled by the air introduced into the fixing part 152.

The air passing through the heat dissipation part 153 is discharged to the outside through the discharge hole 132 of the base cover 13. The passing through the electronic component 151 is mixed with the air passing through the heat dissipation part 153 through the discharge opening 156 of the fixing part 152, and then is discharged to the outside.

According to the cooker 1, the heat dissipation part 153 contacting the electronic component 151 is disposed on the airflow generated by the cooling fan 135. Thus, it may be possible to cool the electronic component.

Also, since the portion of the air suctioned inside the base cover 13 by the cooling fan 135 directly flows to the electronic component 151, a cooling effect of the electronic component 151 may be more maximized.

Hereinafter, an airflow for insulation between the heating source and the cabinet in the built-in type cooker according to this embodiment will be described in detail.

Referring to FIGS. 1 and 6, the operation of the cooker 1 starts, and heat is generated from the heating source 14. The heat generated from the heating source 14 is transferred to the top plate 12 on which the foods are seated as well as the cabinet 10.

As the cooling fan 135 is operated, air is suctioned inside the base cover 13 through the suction holes 131 and 136 of the base cover 13. The suctioned air is divided into two parts by the guide part 133 of the base cover 13. In detail, as described above, a portion of the suctioned air flows along the first flow path 138 to pass through the electronic component 151 and the heat dissipation part 153. Then, the air is discharged again to the outside through the discharge hole 132 of the base cover 13. The remaining air of the suctioned air flows along the second flow path 139 to flow into the flow path 182 through the communication opening 106.

The air introduced into the flow path 182 is divided into two parts by the flow path partitioning part 183 disposed at a side of the flow path 182. In detail, a portion of the air introduced into the flow path 182 flows toward a right side with respect to the flow path partitioning part 183, and the remaining air flows toward a left side with respect to the flow path partitioning part 183. The divided air flowing into the flow path 182 flows toward a rear side of the cabinet 10 along the circumference surface of the cabinet 10, and then, the air is discharged to the outside through the discharge hole 107 of the cabinet 10.

According to the cooker 1, the air inside the flow path 182 heated by the heat generated from the heating source 14 is quickly discharged to the outside, and simultaneously, external air is continuously introduced into the flow path 182. Thus, the insulation effect of the heating source 14 and the cabinet 10 may be further improved.

Furthermore, the phenomenon in which the heat generated from the heating source 14 is transferred to the furniture 2 may be minimized. Thus, it may prevent the furniture 2 from being damaged and deformed by the heat generated during the cooking.

Also, the heat dissipation part 153 and the electronic component 151 are cooled by the cooling fan 135, and simultaneously, new air may be continuously supplied into the flow path 182. That is, the cooling of the electronic component 151 and the insulation between the heating source 14 and the cabinet 10 may be performed at the same time using one cooling fan 135. Also, when compared that two cooling fans having functions different from each other are separately used, an internal structure of the cooker 1 may be more simplified, and the total volume of the cooker 1 may be further reduced.

Since the insulation effect between the heating source and the cabinet 10 increases, a heating source having a relatively large output may be disposed inside the cooker 1. Also, when the same heating source 14 is used, at least one of a width of a lateral direction of the flow path 182 and a distance between the cabinet 10 and the furniture 2 may be further reduced.

Hereinafter, a built-in type cooker according to a second embodiment will be described in detail with reference to the accompanying drawing. This embodiment is different from the first embodiment in a configuration of a lateral insulation plate.

Figure 7:
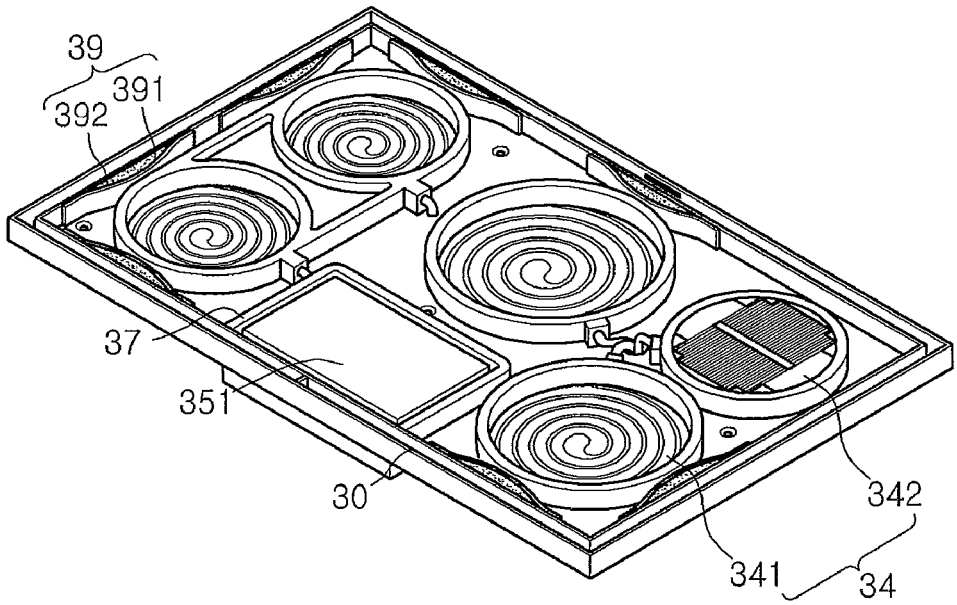
FIG. 7 is a partially perspective view of a built-in type cooker according to a second embodiment.

FIG. 7 is a partially perspective view of a built-in type cooker according to a second embodiment.

Referring to FIG. 7, a lateral insulation plate 39 disposed on an inner circumference surface of a cabinet 30 relatively closed to a heating source 341 for cooking has a thickness greater than that of the lateral insulation plate 39 disposed on the inner circumference surface of the cabinet 30 relatively faraway from the heating source 341 for cooking in a vertical direction with respect to the inner circumference surface of the cabinet 30. That is, the lateral insulation plate 39 has a thickness gradually decreasing from a point of the inner circumference surface of the cabinet relatively closed to the heating source 341 for cooking to a point of the inner circumference surface of the cabinet relatively faraway from the heating source 341 for cooking in the vertical direction with respect to the inner circumference surface of the cabinet 30. At this time, to optimize an insulation effect between the heating source 341 for cooking and the circumference surface of the cabinet 30, the thickness of the lateral insulation plate 39 may be in inverse proportion to a distance from the inner circumference surface of the cabinet disposed on the lateral insulation plate 39 to the heating source 341 for cooking in the vertical direction with respect to the inner circumference surface of the cabinet 30.

According to this embodiment, it may further effectively prevent heat from being transferred from the heating source 341 to the cabinet 30. In detail, an amount of heat radiated from the heating source 341 for cooking to the circumference surface of the cabinet 30 is in inverse proportion to the distance between the heating source 341 for cooking and the inner circumference surface of the cabinet 30. That is, when the heating source 341 for cooking is relatively closed to the inner circumference surface of the cabinet 30, the amount of heat radiated from the heating source 341 for cooking to the circumference surface of the cabinet 30 increases, and when the heating source 341 for cooking is relatively faraway from the inner circumference surface of the cabinet 30, the amount of heat radiated from the heating source 341 for cooking to the circumference surface of the cabinet 30 decreases.

In this embodiment, the lateral insulation plate 39 disposed on an inner circumference surface of a cabinet 30 relatively closed to a heating source 341 for cooking has the thickness greater than that of the lateral insulation plate 39 disposed on the inner circumference surface of the cabinet 30 relatively faraway from the heating source 341 for cooking. That is, the insulation effect increases at a position in which the distance between the heating source 341 for cooking and the inner circumference surface of the cabinet 30 is relatively short than a position in which the distance between the heating source 341 for cooking and the inner circumference surface of the cabinet 30 is relatively long.

Thus, the heat transfer between the heating source 34 and the inner circumference surface of the cabinet 30 may be further effectively prevented by the lateral insulation plate 39.

Also, a space occupied by the lateral insulation plate 39 may be minimized in an internal space of the cabinet 30. That is, the internal space of the cabinet 30 may be effectively utilized.

Hereinafter, a built-in type cooker according to a third embodiment will be described in detail with reference to the accompanying drawing. This embodiment is different from the first embodiment in a configuration of a lateral insulation plate.

Figure 8:
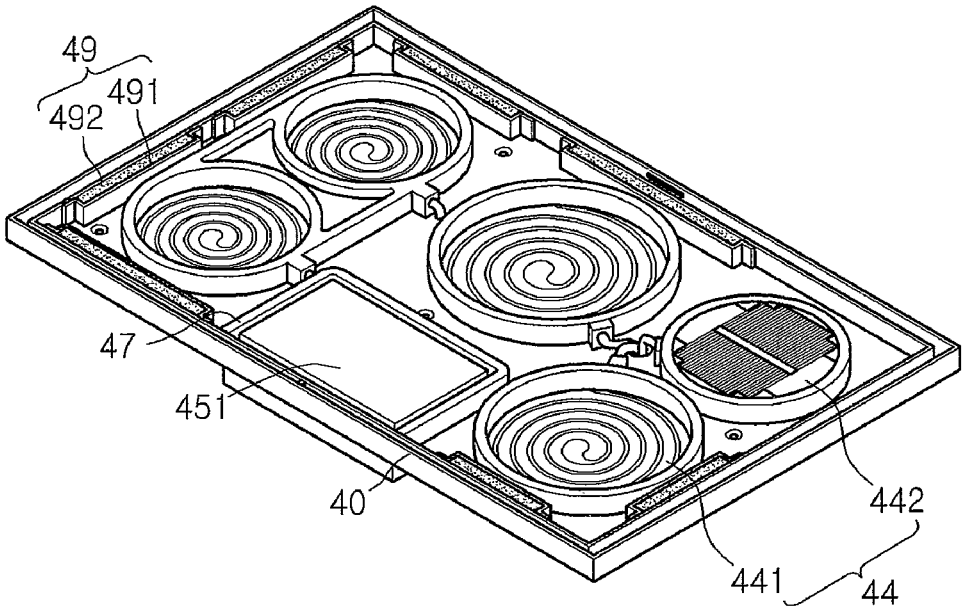
FIG. 8 is a partially perspective view of a built-in type cooker according to a third embodiment.

FIG. 8 is a partially perspective view of a built-in type cooker according to a third embodiment.

Referring to FIG. 8, in a plurality of regions corresponding to a lateral insulation plate 49 on an inner circumference surface of a cabinet 40, the lateral insulation plate 49 disposed in a region in which the shortest distance between a heating source 441 for cooking and the inner circumference surface of the cabinet 40 is relatively short has an area greater than that disposed in a region in which the shortest distance between a heating source 441 for cooking and the inner circumference surface of the cabinet 40 is relatively long. That is, the lateral insulation plate 49 disposed in a region in which the shortest distance between a heating source 441 for cooking and the inner circumference surface of the cabinet 40 is relatively short may be longitudinally disposed along the inner circumference surface of the cabinet 10 when compared to the lateral insulation plate 49 disposed in a region in which the shortest distance between a heating source 441 for cooking and the inner circumference surface of the cabinet 40 is relatively long.

According to this embodiment, heat transfer between the heating source 44 to the cabinet 40 may be further effectively prevented. In detail, when the shortest distance between a heating source 441 for cooking and the inner circumference surface of the cabinet 40 is relatively short, the heat generated from the heating source 441 for cooking is radiated in a more wide area of the inner circumference surface of the cabinet 40. Thus, since the lateral insulation plate 49 is disposed on a position at which the shortest distance between the heating source 441 for cooking and the inner circumference surface of the cabinet 40 is relatively short to increase an insulation area thereof, the insulation effect may further improved.

Thus, the heat transfer between the heating source 34 and the inner circumference surface of the cabinet 30 may be further effectively prevented by the lateral insulation plate 49.

Hereinafter, a built-in type cooker according to a fourth embodiment will be described in detail with reference to the accompanying drawing. This embodiment is different from the first embodiment in a configuration of a lateral insulation plate.

Figure 9:
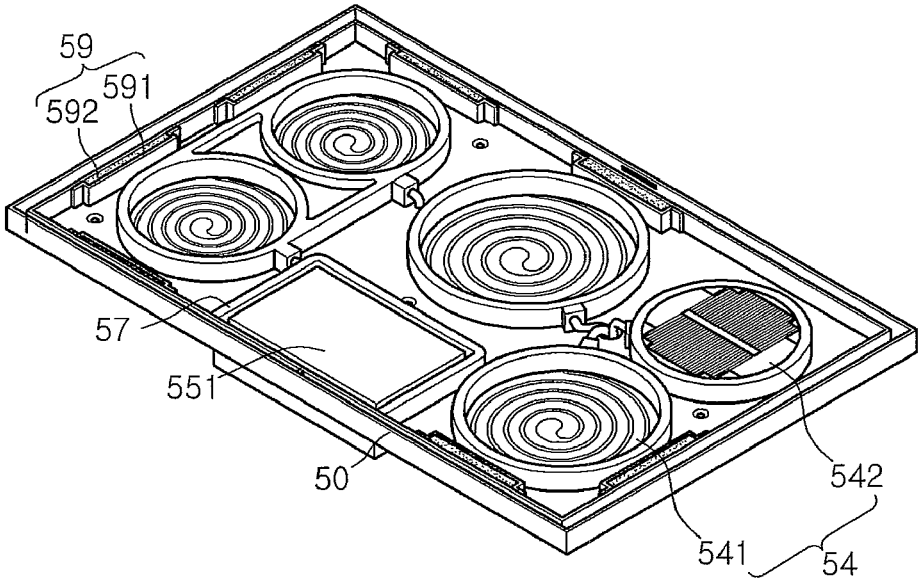
FIG. 9 is a partially perspective view of a built-in type cooker according to a fourth embodiment.

FIG. 9 is a partially perspective view of a built-in type cooker according to a fourth embodiment.

Referring to FIG. 9, in a plurality of regions corresponding to a lateral insulation plate 59 on an inner circumference surface of a cabinet 50, the lateral insulation plate 59 disposed in a region in which the shortest distance between a heating source 541 for cooking and the inner circumference surface of the cabinet 50 is relatively short has a thickness greater than that disposed in a region in which the shortest distance between a heating source 541 for cooking and the inner circumference surface of the cabinet 50 is relatively long.

According to this embodiment, it may further prevent heat from being transferred from the heating source 54 to the cabinet 50. In detail, when the shortest distance between a heating source 541 for cooking and the inner circumference surface of the cabinet 50 is relatively short, the heat generated from the heating source 541 for cooking may be further effectively radiated. Thus, since the lateral insulation plate is disposed on a position at which the shortest distance between the heating source 541 for cooking and the inner circumference surface of the cabinet 50 is relatively short to increase the thickness thereof, the insulation effect may further improved.

Therefore, the heat transfer between the heating source 54 and the inner circumference surface of the cabinet 50 may be further effectively prevented by the lateral insulation plate 59.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A built-in cooker comprising:

a cabinet having an upwardly opened polyhedral shape;

a top plate covering a top surface of the cabinet;

an electronic component installed within the cabinet;

a heat dissipation part in which at least a portion thereof is disposed outside of the cabinet, the heat dissipation part being connected to the electronic component; and a cover coupled to an outside of the cabinet, the heat dissipation part being mounted to the cover.

2. The built-in cooker according to claim 1, further comprising a fan, which generates an airflow toward the electronic component and an airflow toward the heat dissipation part at the same time.

3. The built-in cooker according to claim 1, wherein the cover is provided with a suction hole and a discharge hole for respectively suctioning and discharging air for cooling the heat dissipation part.

4. The built-in cooker according to claim 3, wherein a suction opening through which a portion of air flowing toward the heat dissipation part flows toward the electronic component and a discharge opening in which the air passing through the electronic component is mixed with the air passing through the heat dissipation part are defined in the cabinet.

5. The built-in cooker according to claim 4, further comprising a guide part guiding the portion of the air flowing toward the heat dissipation part such that the air flows toward the electronic component through the suction opening.

6. The built-in cooker according to claim 1, further comprising:

a heating source disposed inside the cabinet;

an insulation flow path disposed between the cabinet and the heating source to insulate the cabinet from the heating source; and a fan for blowing air along the insulation flow path.

7. The built-in cooker according to claim 6, wherein the insulation flow path is disposed between the cabinet and a partitioning member disposed inside the cabinet to partition the inside of the cabinet into two spaces.

8. The built-in cooker according to claim 6, wherein the cover covers the heat dissipation part; and further comprising:

a guide part partitioning the inside of the cover into a first flow path through which a portion of air introduced into the cover flows toward the heat dissipation part to cool the heat dissipation part and a second flow path through which the remaining air flows toward the insulation flow path.

9. The built-in cooker according to claim 6, wherein the cover covers the heat dissipation part, and wherein a communication opening through which the inside of the cover communicates with the insulation flow path is defined in the cabinet.

10. The built-in cooker according to claim 9, wherein the insulation flow path of the cabinet is disposed along a circumference surface of the cabinet, and a discharge hole through which the air within the insulation flow path is discharged is defined in a side of the cabinet corresponding to the same distance in both directions on the insulation flow path with respect to the communication opening.

11. The built-in cooker according to claim 10, wherein a flow path partitioning part configured to divide air flowing from the cover to the insulation flow path to respectively guide the air such that the air flows along two flow paths respectively communicating with the communication opening and the discharge hole is disposed in the insulation flow path of the cabinet.

12. The built-in cooker according to claim 1, further comprising:

a heating source disposed inside the cabinet;

an electric wire connected to the heating source; and an insulation plate disposed between the heating source and the electric wire.

13. The built-in cooker according to claim 12, wherein the insulation plate comprises:

an insulation part partitioning the inside of the cabinet into a space in which the heating source is disposed and a space for insulating the heating source from a bottom surface of the cabinet; and an insulation material received into the space defined by the insulation part to insulate the heating source from a bottom surface of the cabinet.

14. The built-in cooker according to claim 13, wherein a hole through which the electric wire passes is defined in the insulation part.

15. The built-in cooker according to claim 1, further comprising:

a heating source disposed inside the cabinet;

an electronic component installed within the cabinet;

an electric wire connected to the heating source; and an insulation plate disposed on a bottom surface of the cabinet, wherein the electric wire has one end connected to the heating source and introduced into the insulation plate and the other end withdrawn from the insulation plate and connected to the electronic component.

16. The built-in cooker according to claim 1, further comprising:

a heating source disposed inside the cabinet, the heating source heating foods; and an insulation plate disposed between a circumference surface of the cabinet and the heating source to prevent heat from being transferred from the heating source to the cabinet.

17. The built-in cooker according to claim 16, wherein the insulation plate is provided in plurality on the inner circumference surface of the cabinet such that the plurality of insulation plates corresponds to a plurality of regions corresponding to a distance less than a preset distance from the insulation plate to the heating source in a direction perpendicular to the inner circumference surface of the cabinet.

18. The built-in cooker according to claim 17, wherein, in the plurality of regions, the insulation plate corresponding to a region in which the shortest distance between a heating source and the inner circumference surface of the cabinet is relatively short has a thickness or area greater than that corresponding to a region in which the shortest distance between a heating source and the inner circumference surface of the cabinet is relatively long.

19. The built-in cooker according to claim 1, further comprising:

a heating source disposed inside the cabinet; and a support supporting the heating source, the support being seated on a bottom surface of the cabinet, wherein an upwardly formed forming part is disposed on the bottom surface of the cabinet, and a downwardly formed forming part is disposed on the support at a point corresponding to the forming part of the cabinet to contact the forming part of the cabinet.

20. The built-in cooker according to claim 19, wherein a hole through which a coupling member for coupling the cabinet to the support passes is defined in the forming parts of the cabinet and the support, and the coupling member is disposed inside the forming part in a state where the support is coupling to the cabinet.

* * * * *